US006792984B2

(12) United States Patent
Fontaine

(10) Patent No.: US 6,792,984 B2
(45) Date of Patent: Sep. 21, 2004

(54) ROUTER LIFT

(75) Inventor: Norston Fontaine, Minneapolis, MN (US)

(73) Assignee: Bench Dog, Inc., Minneapolis, MN (US)

( * ) Notice: Subject to any disclaimer, the term of this patent is extended or adjusted under 35 U.S.C. 154(b) by 0 days.

(21) Appl. No.: 10/175,107

(22) Filed: Jun. 19, 2002

(65) Prior Publication Data

US 2002/0189713 A1 Dec. 19, 2002

Related U.S. Application Data

(60) Provisional application No. 60/299,298, filed on Jun. 19, 2001.

(51) Int. Cl.[7] ..... B27C 5/10
(52) U.S. Cl. ..... 144/135.2; 409/182
(58) Field of Search ..... 144/135.2, 136.95, 144/154.5, 371, 134.1, 135.3; 408/181, 182; 409/182

(56) References Cited

U.S. PATENT DOCUMENTS 2,582,573 A * 1/1952 Von Guten ..... 144/135.2
5,139,061 A * 8/1992 Neilson ..... 144/135.2
5,289,861 A * 3/1994 Hedrick ..... 144/135.2
5,310,296 A * 5/1994 McCurry ..... 409/182
5,325,899 A * 7/1994 Kochling ..... 144/144.1
5,586,591 A * 12/1996 Gaydos ..... 144/145.2
5,699,844 A * 12/1997 Witt ..... 144/329
5,725,036 A * 3/1998 Walter ..... 144/135.2
5,918,652 A * 7/1999 Tucker ..... 144/371
6,139,229 A 10/2000 Bosten et al.
6,224,305 B1 * 5/2001 Huggins ..... 409/182
6,318,936 B1 11/2001 McFarlin, Jr. et al.

* cited by examiner

*Primary Examiner*—Allen Ostrager
*Assistant Examiner*—Shelley Self
(74) *Attorney, Agent, or Firm*—Crompton, Seager & Tufte LLC

(57) ABSTRACT

Devices and systems for adjustably positioning a router on a work surface such as a router table are disclosed. A router lift in accordance with an exemplary embodiment of the present invention includes a top plate having an opening therethrough adapted to receive a router bit, one or more columns extending from the bottom surface of the top plate, a router housing operatively coupled to the one or more columns, and a power screw threadably connected through the top plate and housing. The housing may include a generally circular portion defining a cylindrical aperture that can be adjusted to accommodate for various router sizes. The housing may also include cooling fins to dissipate heat generated from the router. A calibration dial having a scale that can be used to measure elevation of the router and router bit relative to the top plate may also be used.

54 Claims, 8 Drawing Sheets

ROUTER LIFT

CROSS REFERENCE TO RELATED APPLICATION

The present application claims the benefit of U.S. Provisional Application Serial No. 60/299,298, filed on Jun. 19, 2001.

FIELD OF THE INVENTION

The present invention relates generally to the field of machines and tools for cutting and shaping wood. More particularly, the present invention relates to devices and systems for adjustably mounting a router to a work surface.

BACKGROUND OF THE INVENTION

Routers are frequently utilized in woodworking to cut or form wood to a desired shape or size. These devices typically comprise a top plate that can be used to support the router against the surface to be routed, a router motor having a rotatable drive shaft, and a router bit. Examples of applications involving the use of routers include routing, grooving, fluting, shaping and beading.

Conventionally, routers are either fixed-base or plunge-type. In a fixed-base router, for example, the depth of the router bit is typically adjusted by raising or lowering the router motor using, for example, a rack and pinion. In a plunge-type router, the router motor is typically mounted to several columns that can be actuated to change the depth of the router bit during operation. In some applications, it may be desirable to mount the router to a table or other work surface to support the workpiece as it passes the router bit. A guide mechanism such as a fence may be employed to guide the workpiece along the work surface. Moreover, a guide bushing may also be placed within an opening on the top plate to guide the workpiece around the router bit for certain procedures such as template or inlay cutting.

When performing a woodworking operation, it may become necessary to adjust or replace the router bit. In a conventional table mounted router, adjustment of the router bit may require the operator to physically remove the router from the router housing in order to access the bit. Once removed, the operator can then loosen the router chuck holding the router bit. In other cases, adjustment of the router bit may require the operator to replace or change the router bit from the underside of the router table where access is often limited. During this process, the depth of the router bit may be compromised, requiring the operator to re-adjust the bit depth prior to continuing the woodworking operation. Since many routers lack an accurate and convenient adjustment mechanism to set the depth of the router bit, such adjustments can often prove difficult and time consuming.

SUMMARY OF THE INVENTION

The present invention relates generally to the field of machines and tools for cutting and shaping wood. More particularly, the present invention relates to devices and systems for adjustably mounting a router to a work surface. A router lift in accordance with an exemplary embodiment of the present invention includes a top plate having an opening therethrough adapted to receive a router bit, one or more columns extending from the bottom surface of the top plate, a router housing operatively coupled to the one or more columns, and a power screw threadably connected through the top plate and the router housing. A socket fitting attached to one end of the power screw, and extending through a threaded opening on the top plate, may be engaged by a socket to rotate the power screw and adjust the depth of the router bit.

In some embodiments, the router housing may include a generally circular portion defining a cylindrical aperture configured to receive the router. A slot extending through the generally circular portion into the cylindrical aperture may be adjusted to increase or decrease the inner diameter of the cylindrical aperture to accommodate for various router sizes. Moreover, the router housing may include cooling fins to dissipate heat generated from the router during operation.

The router lift may further include a lift calibration dial to permit accurate measurement of the router bit depth. The lift calibration dial may include a cylindrical portion defining a lumen adapted to receive the socket, and a disc portion having a scale for measuring the elevation of the router and/or the router bit. In use, a zero point mark on the lift calibration dial can be initially aligned with an index mark located on the top plate adjacent the socket fitting. As the socket is rotated to raise or lower the router lift, the scale located on the lift calibration dial can be used to ascertain a measure of the router bit depth.

DETAILED DESCRIPTION OF THE INVENTION

The following description should be read with reference to the drawings, in which like elements in different drawings are numbered in like fashion. The drawings, which are not necessarily to scale, depict selected embodiments and are not intended to limit the scope of the invention. Although examples of construction, dimensions, materials and manufacturing processes are illustrated for the various elements, those skilled in the art will recognize that many of the examples provided have suitable alternatives that may be utilized.

Figure 1:
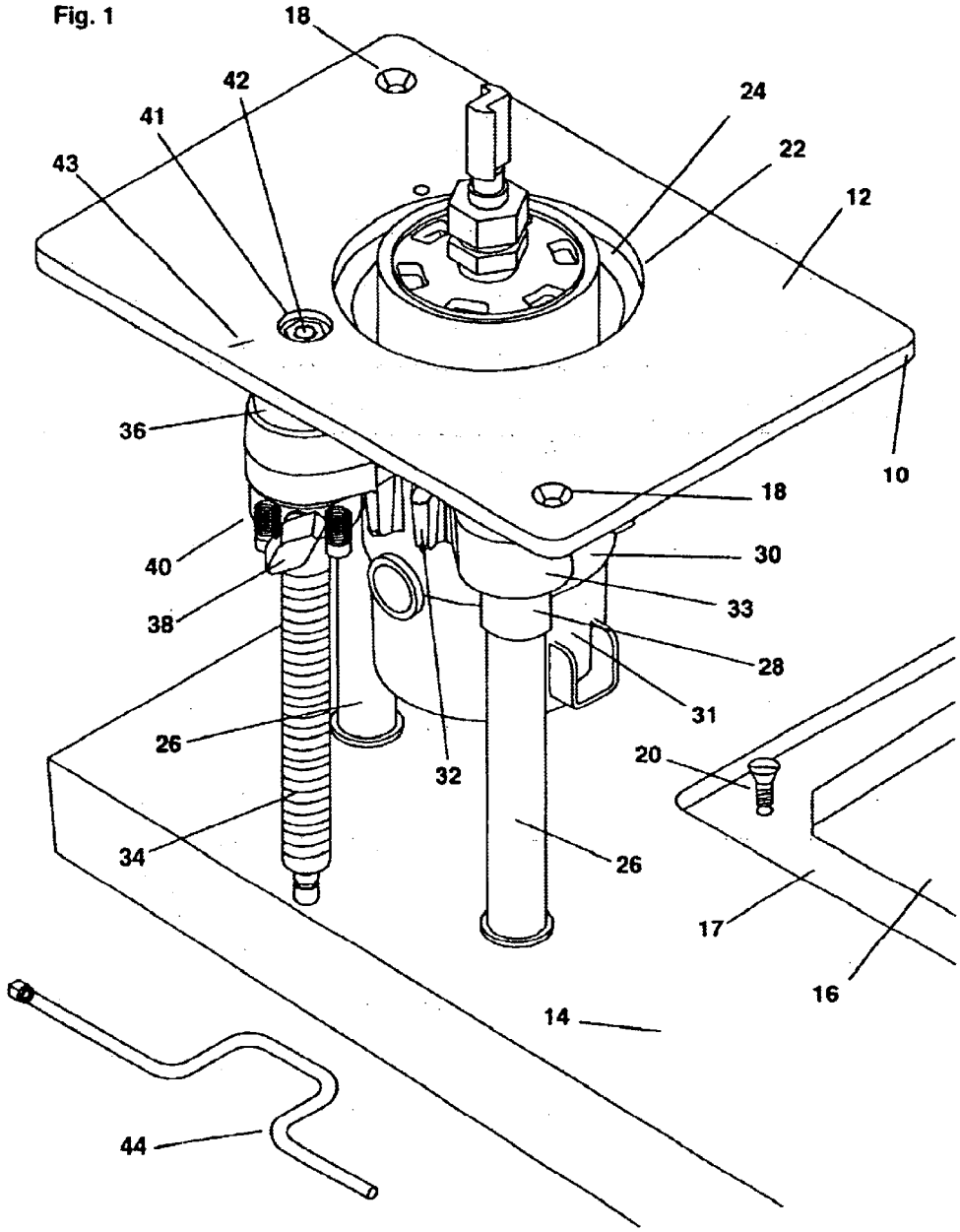
FIG. 1 is a front perspective view of a router lift in accordance with an exemplary embodiment of the present invention.

FIG. 1 is a front perspective view of a router lift 10 in accordance with an exemplary embodiment of the present invention. Router lift 10 includes a top plate 12 configured in size and shape to fit flush within an opening 16 formed on a router table 14 or other suitable work surface. The opening 16 of router table 14 may have a recessed flange 17 therein configured to receive the top plate 12 of router lift 10. The depth of the recessed flange 17 can be configured to permit the top surface of top plate 12 to lie flush with the top surface of the router table 14. In addition, the perimeter of opening 16 can be configured to generally conform to the size and shape of the perimeter of top plate 12, thus providing a relatively smooth work surface free from gaps or surface irregularities that could interrupt the flow of the workpiece as it advances along the surface of the router table 14.

Top plate 12 includes an opening 22 configured to receive a router bit (not shown) therethrough. Opening 22 can include a recessed periphery flange 24 configured to receive an insert plate and/or guide bushing. If desired, the top plate 12 can further include one or more countersunk holes 18 for receiving screws 20 that permit the operator to attach the router lift 10 to the router table 14. As shown in FIG. 1, for example, router lift 10 can be attached to the router table 14 via two countersunk holes 18 located at opposite corners of the top plate 12.

Top plate 12 may be formed any number of metallic materials such as an anodized aluminum alloy or cast iron. In some implementations, the top plate 12 may include a nickel chrome finish or other suitable coating. The selection of materials for the top plate 12 and other components of the router lift 10 may depend on several factors, including durability, cost, surface texture, weight, heat dissipation, corrosion resistance and other user preferences.

Extending from the bottom of top plate 12 are several generally cylindrical columns 26 connected to a router housing 30 configured to receive a router 31. As with the top plate 12, housing 30 may be formed from any number of suitable materials such as cast iron or aluminum. In the exemplary embodiment of FIG. 1, router housing 30 has a generally circular shape defining a central cylindrical aperture configured to receive the router 31.

To dissipate heat generated during the operation of the router 31, router housing 30 may further include a plurality of cooling fins 32 extending therefrom. The cooling fins 32 can be sized to provide a larger surface area for improved heat transfer during operation of the router 31. Moreover, the cooling fins 32 may be formed from a material having a greater thermal conductivity than the router 31, further improving heat dissipation from the router 31.

Router housing 30 further includes several collets 33 adapted to slidably receive the columns 26. Disposed within each collet 33 is a bushing 28. The bushing 28 provides a clearance fit for the columns 26, allowing the columns 26 to slide within the collet 33. In certain implementations, the bushings 28 may be formed of an aluminum bronze alloy, and the columns 26 may be formed from steel that has been turned, ground and polished.

Router lift 10 further includes a power screw 34 threadably connected through top plate 12 by female plate threads 36, and to the router housing 30 by threaded collar 38.

Attached to the upper end of the power screw 34, and extending through an opening 41 in the top plate 12, is a hex or socket fitting 42. A socket or hex wrench 44 can be utilized to rotate the socket fitting 42 and attached power screw 34 to increase or decrease the elevation of the router 31 relative to the top plate 12. As described in greater detail below, an index mark 43 located on the top surface of top plate 12 adjacent opening 41 can be used by the operator to calibrate the depth of the router 31.

Figure 2:
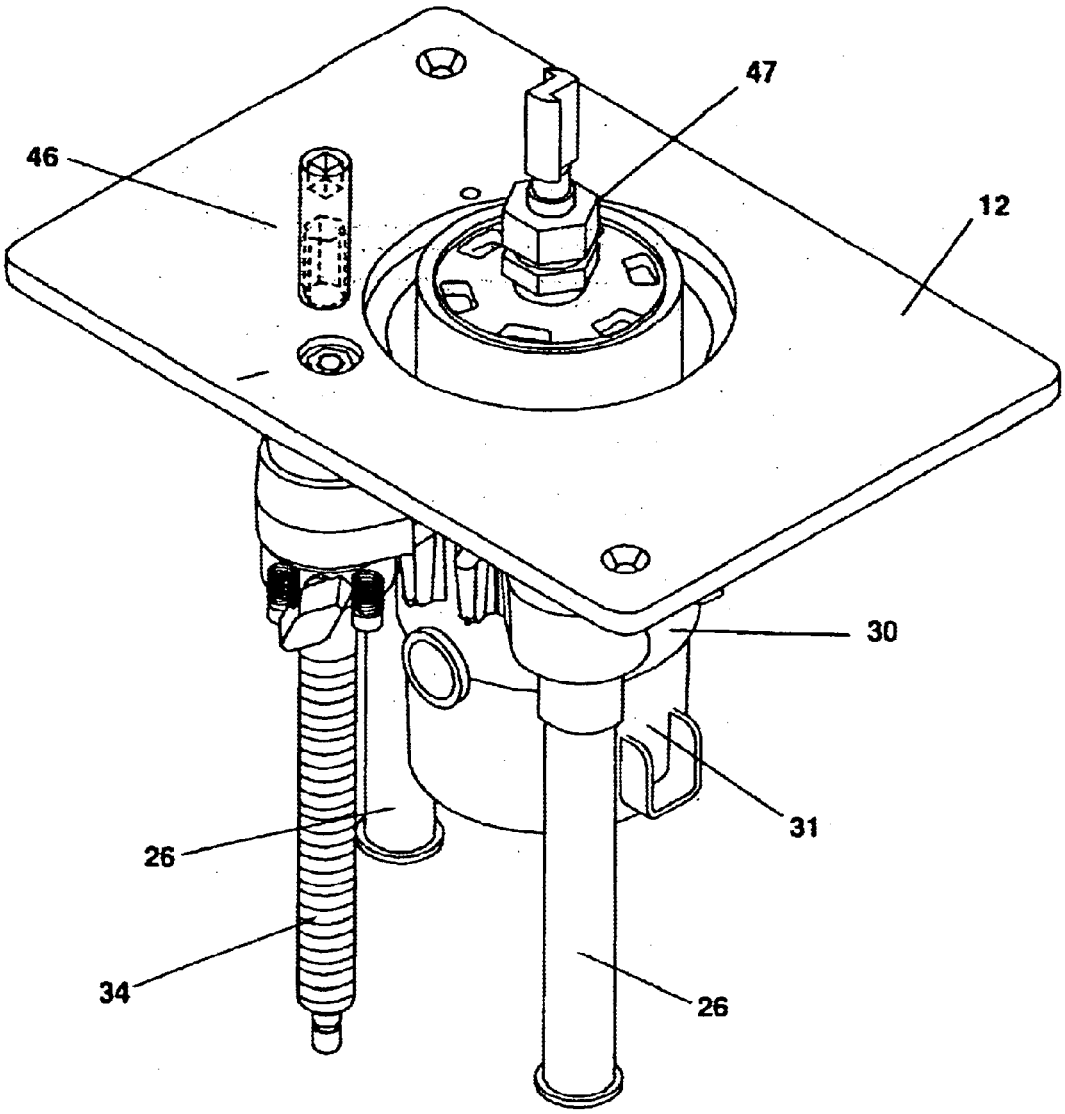
FIG. 2 is a front corner perspective view of the router lift in FIG. 1, showing the router housing and router adjusted in an upward direction such that the router chuck is elevated at least in part above the top plate.

FIG. 2 is a front corner perspective view of router lift 10, showing the router 31 adjusted in an upward direction. A socket 46 is shown disposed on socket fitting 42 within opening 41. To adjust the depth of the router 31, the operator rotates the socket 46 with a wrench, causing the power screw 34 to advance the router housing 30 and attached router 31 towards the top plate 12. A router chuck 49 attached to the drive shaft 47 of the router 31 is then raised through opening 22 of top plate 12, allowing the operator to replace or change the router bit above the surface of the top plate 12. Although the router chuck 49 illustrated in FIG. 2 is a locking collet, it is to be understood that any suitable attachment means to lock the router bit to the drive shaft 47 may be employed. For example, a spindle lock or auto release collet may be employed, if desired.

As shown in FIG. 2, columns 26 and power screw 34 are disposed to one side of the drive shaft 47 of the router assembly 31. As a result of this arrangement, router 31 is cantilevered towards the other side of drive shaft 47. This cantilevered force biases the threaded collar 38 in an upward direction along the power screw 34.

Figure 3:
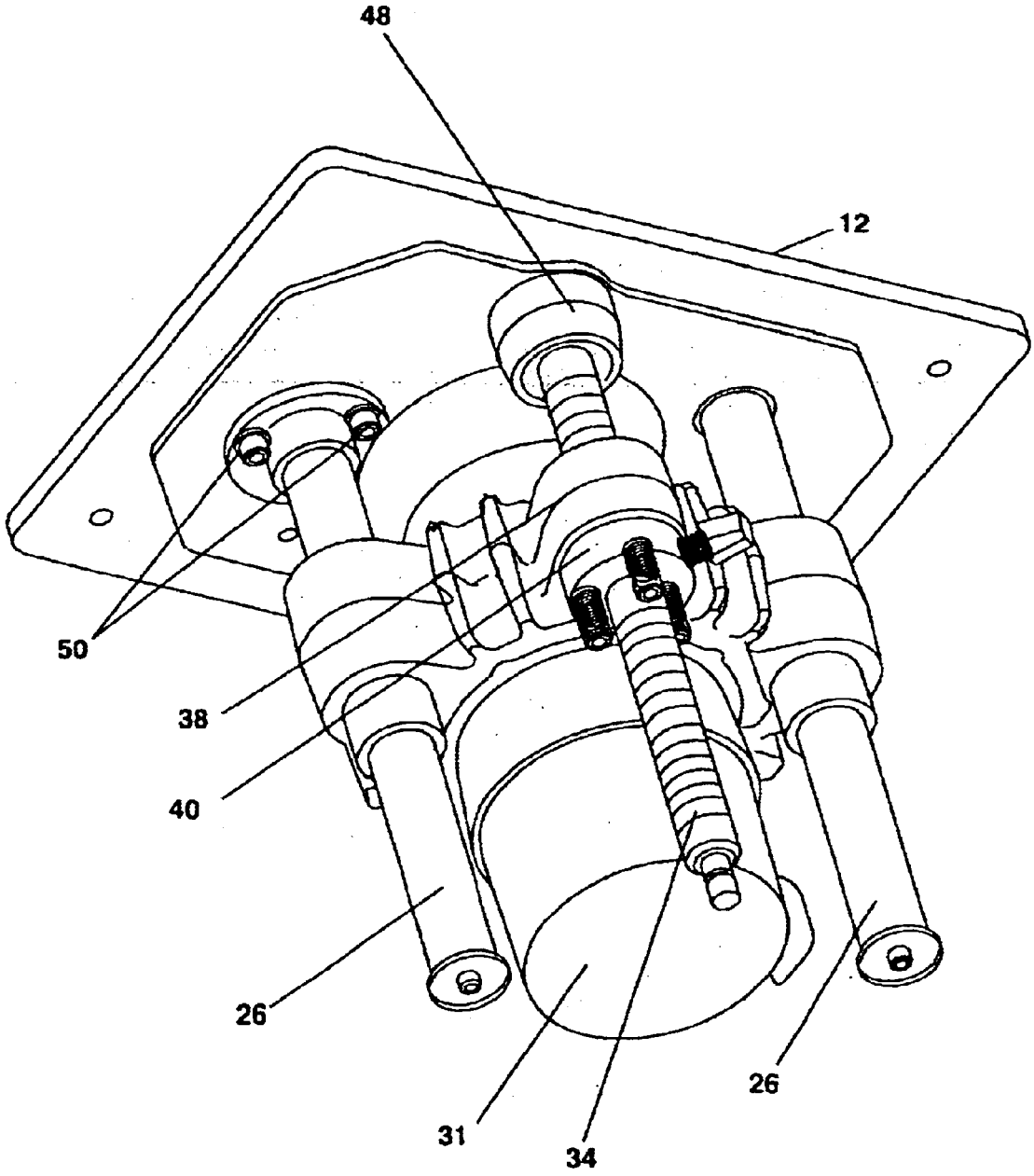
FIG. 3 is a bottom front perspective view of the router lift of FIG. 1, showing the attachment of the columns and power screw to the router housing and top plate.

To counterbalance this upward bias, threaded collar 38 may include a back-loaded threaded bushing 40. As shown in FIG. 3, threaded bushing 40 can be threadably attached to the power screw 34 below the threaded collar 38. The threaded bushing 40 acts as a spring, exerting a back-loaded spring force on the power screw 34 and threaded collar 38. The spring force of the threaded bushing 40 against the power screw 34 and threaded collar 38 substantially prevents the columns 26 from locking against the bushings 28 when power screw 34 is rotated.

Disposed within the female plate threads 36 located on top plate 12 is a polymeric insert 48. Polymeric insert 48 may comprise any number of suitable polymeric materials, including polypropylene (PP), polytetraflouroethylene (PTFE), polyvinylchloride (PVC), polyethylene, ABS, or any combination thereof. The polymeric insert 48 includes threads configured to engage the power screw 34 when rotated.

As can be further seen in FIG. 3, each column 26 is attached to the underside of top plate 12 by a flanged fitting 51. Flanged fitting 51 has an inner diameter (not shown) configured to securely receive an end of the column 26. The flanged fitting 51 is connected to bottom surface of the top plate 12 by several fasteners 50. The fasteners 50 (e.g. hex or socket screws) are configured to secure the flanged fitting 51 to the top plate 12.

Figure 4:
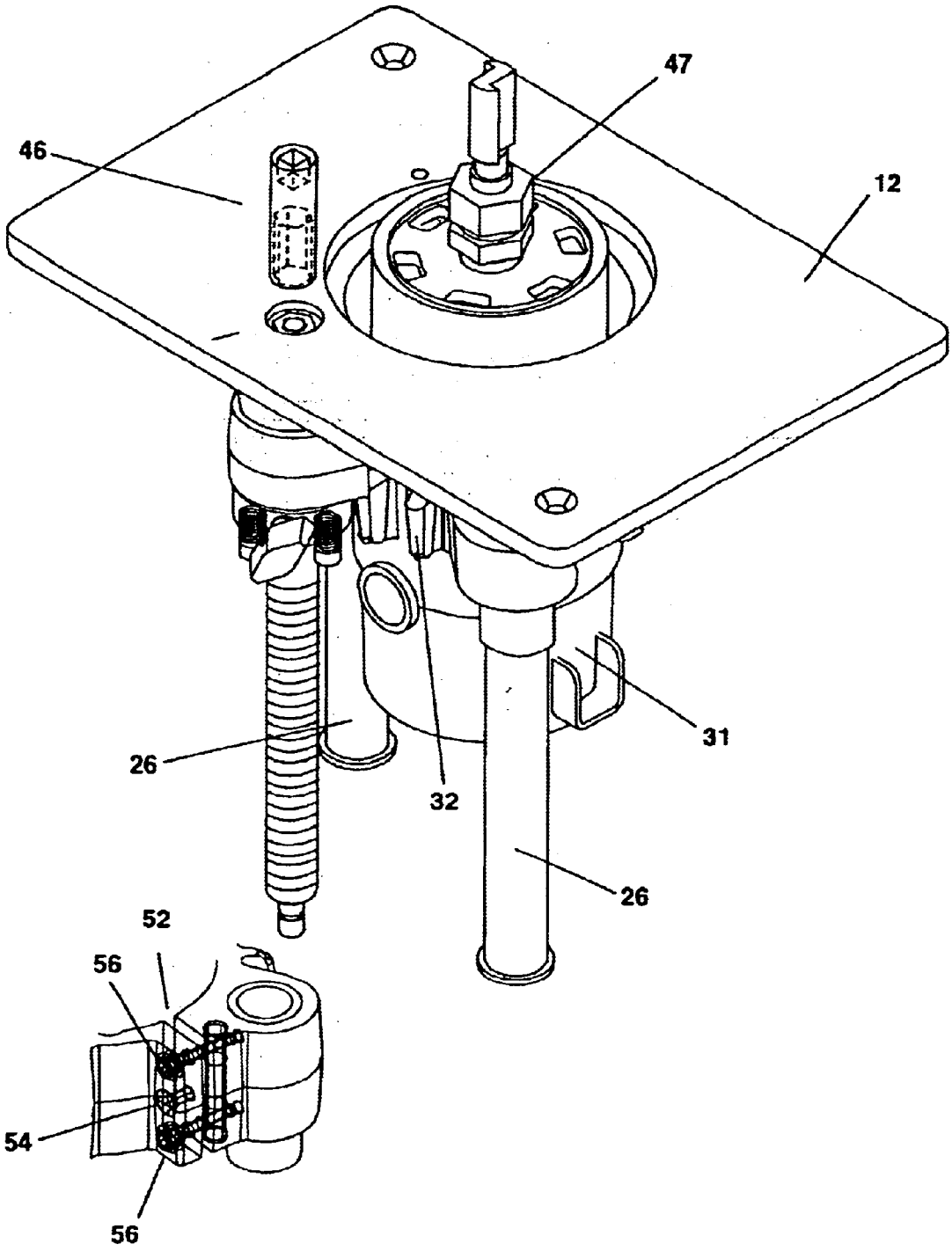
FIG. 4 is a rear perspective view of the router lift of FIG. 1, showing the router chuck fully elevated above the top plate.

FIG. 4 is a rear perspective view of router lift 10, showing the router chuck 49 fully elevated above the top plate 12. As can be seen in FIG. 4, router housing 30 may include a clamp portion 52 that can be used to adjust the size of the cylindrical aperture for receiving various sized routers 31. Clamp portion 52 forms a slot (not shown) extending through the cylindrical portion of housing 30 into the cylindrical aperture. The slot can be widened by advancing a screw into a threaded opening 32 located on the clamp portion 52. When engaged therein, the screw overcomes the bias within router housing 30 tending to close the slot, allowing the operator to insert the router 31 into the cylindrical aperture of the router housing 30. Once the router 31 is placed within the router housing 30, screws 56 can be used to decrease the width of the slot to clamp the cylindrical portion of the router housing 30 to the router 31.

Figure 5:
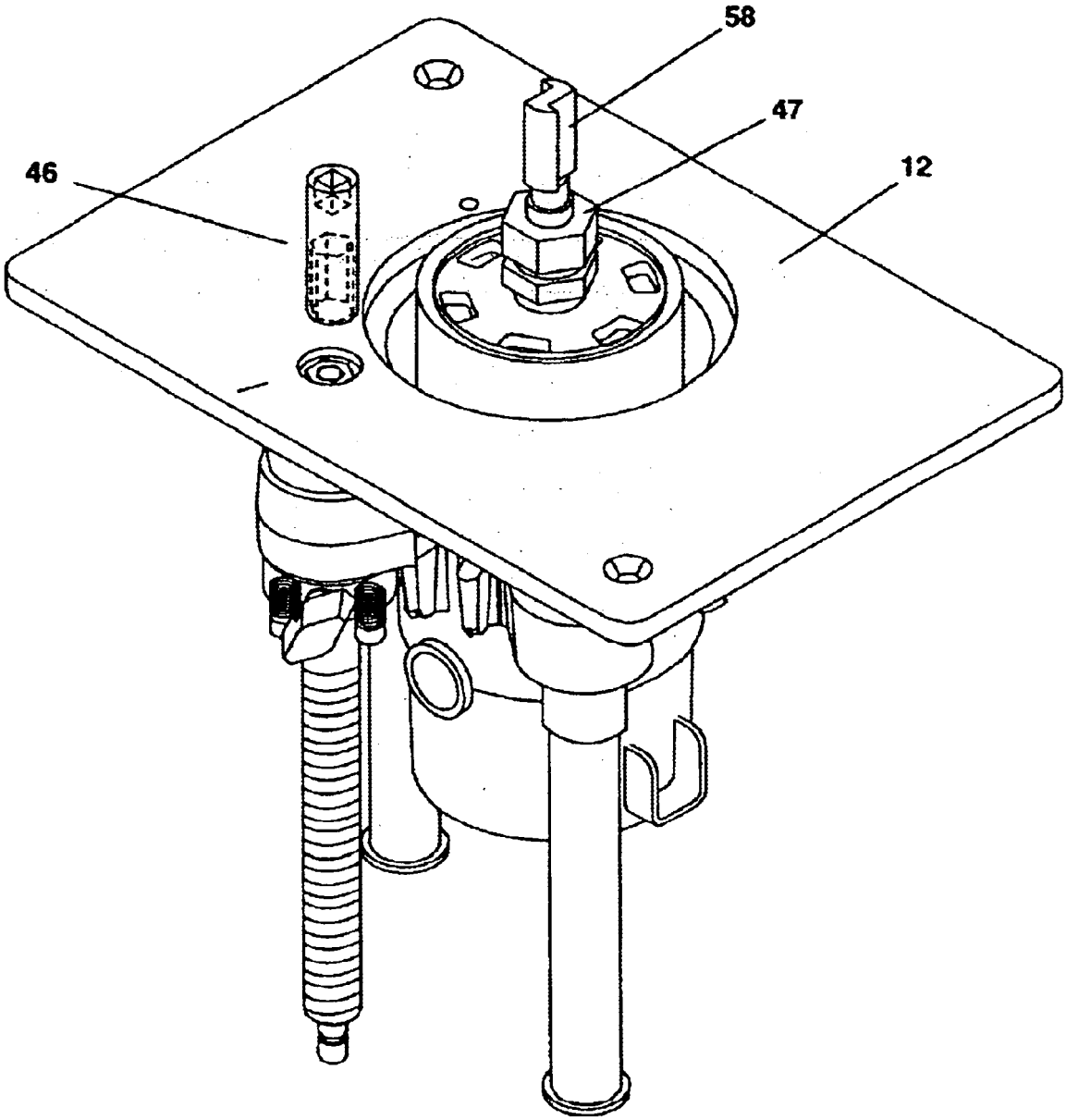
FIG. 5 is a top perspective view of the router lift of FIG. 1, showing a router bit attached to the router chuck.

FIG. 5 is a top view of router lift 10, showing a router bit 58 raised top plate 12. In the view illustrated in FIG. 5, socket 46 has been rotated several turns such that the router 31 is fully elevated above the top plate 12. In this position, the router chuck 49 is extended through opening 22, allowing the operator to access the router chuck 49 above the top surface of the top plate 12. A collet wrench (not shown) may be used to change or replace the router bit 58.

Figure 6:
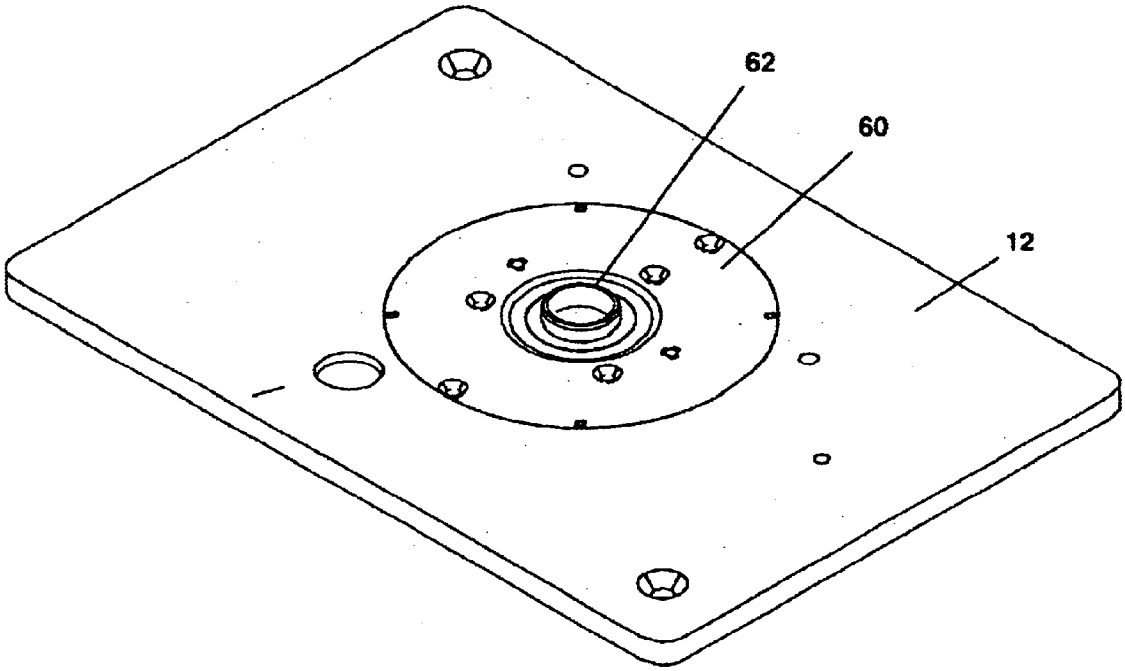
FIG. 6 is another front perspective view of the router lift of FIG. 1, showing an insert plate and guide bushing disposed within the top plate opening.

FIG. 6 is a front perspective view of router lift 10, showing an insert plate 60 placed on the recessed periphery flange 24 of opening 22. In the exemplary embodiment illustrated in FIG. 6, insert plate 60 is generally annular in shape, having a size and shape such that the top surface of the insert plate 60 lies flush with the top surface of the top plate 12. The insert plate 60 can be releasably secured to the top plate 12 with a screw or other fastening means. A guide bushing 62 may be placed within the opening on the insert plate 60 to provide a guide for the workpiece, if desired.

Figure 7:
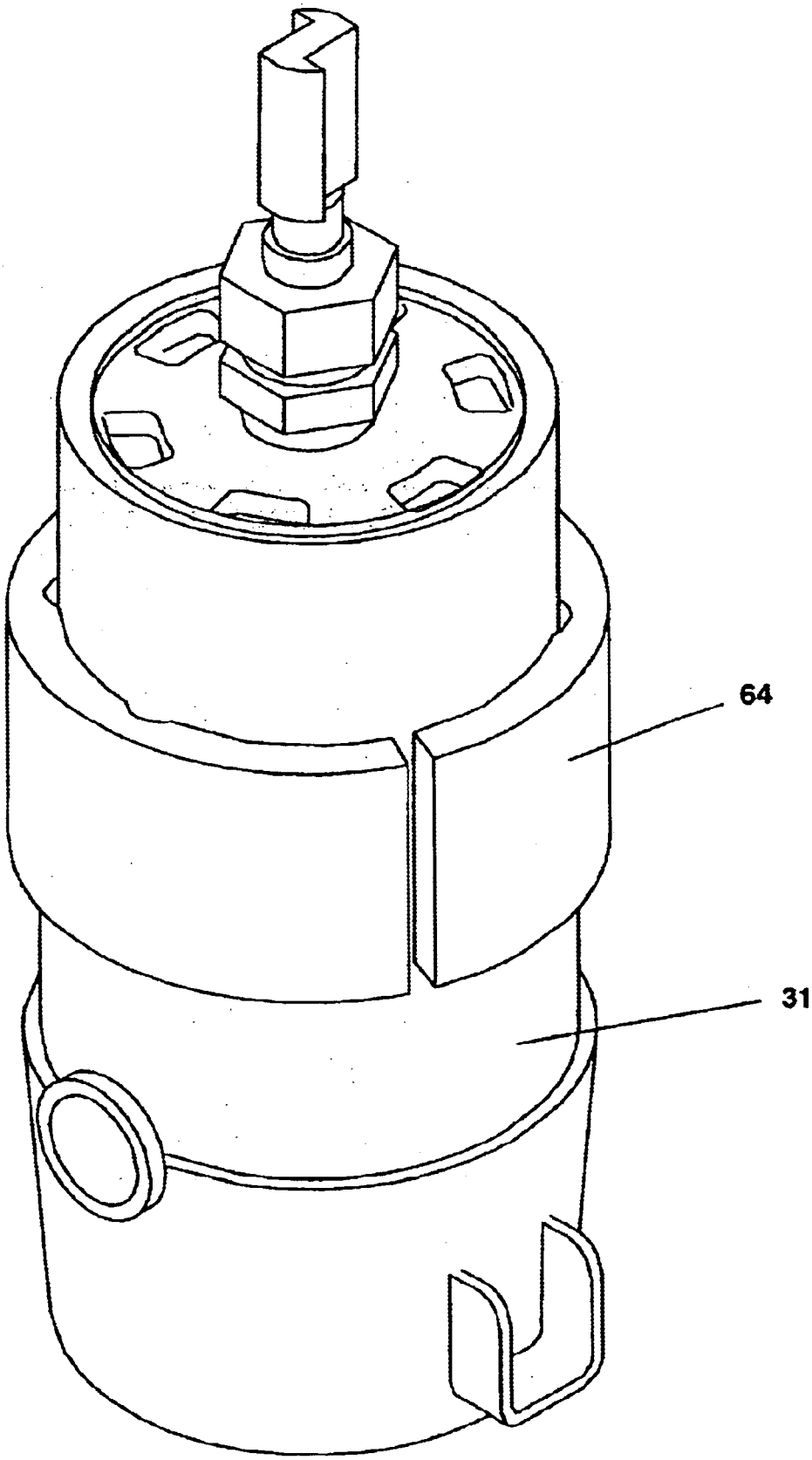
FIG. 7 is a perspective view of a different router than that illustrated in FIGS. 1–6 having a smaller outer diameter, and having a sleeve configured in size and shape to fit within the cylindrical aperture of the router housing.

FIG. 7 is a perspective view of an alternative router 131 for use with the present invention having a smaller outer diameter, and employing a sleeve 64 configured in size and shape to fit within the cylindrical aperture of router housing 30. As shown in FIG. 7, sleeve 64 can be placed around the router 131 to increase its outer diameter such that it can fit within the cylindrical aperture of housing 30 in a manner similar to that of router 31 described above. Sleeve 64 can be configured to permit any number of different sized routers to be inserted into the router housing 30. In addition, sleeve 64 may be formed from a material having a greater thermal conductivity than the router to improve heat dissipation from the router.

Figure 8:
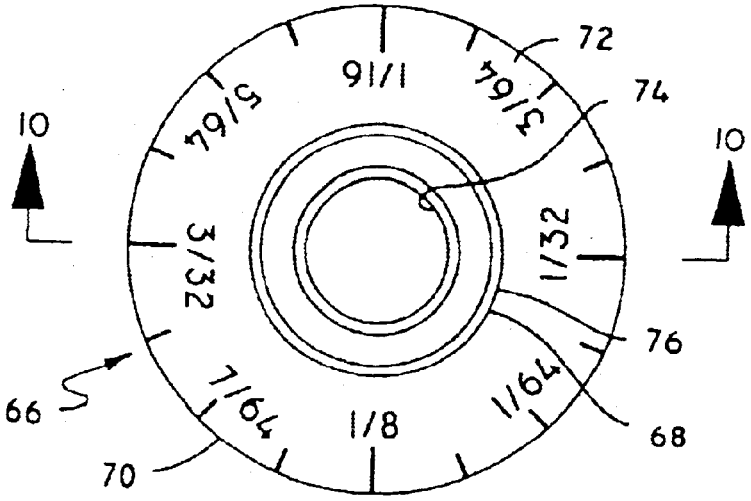
FIG. 8 is a cross-sectional view of a lift calibration dial in accordance with an exemplary embodiment of the present invention.
Figure 10:
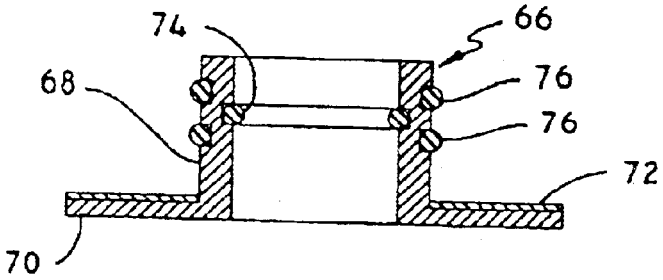
FIG. 10 is a top view of the lift calibration dial of FIG. 8, showing the markings on the scale.
Figure 9:
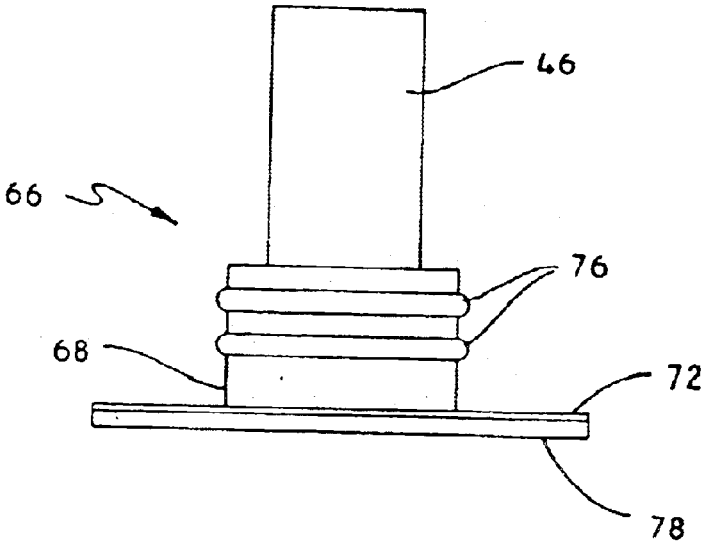
FIG. 9 is a plan view of the lift calibration dial of FIG. 8, showing the lift calibration dial disposed about the socket.

Referring now to FIGS. 8–10, a lift calibration dial 66 in accordance with an exemplary embodiment of the present invention will now be described. As shown in FIG. 8, lift calibration dial 66 comprises a cylindrical portion 68 and a disc portion 70. The cylindrical portion 68 of lift calibration dial 66 defines an inner lumen 69 configured to receive the socket 46. A scale 72 located on the top surface 73 of the disc portion 70 can be used, for example, to obtain a measure of the router bit depth.

An O-ring 74 disposed within the inner lumen 69 of cylindrical portion 68 can be utilized to releasably secure the lift calibration dial 66 to socket 46. O-ring 74 can be dimensioned to create a slight interference fit between the socket 46 and the inner lumen 69 of the lift calibration dial 66. A grove 71 formed within the cylindrical portion 68 of lift calibration dial 66 prevents the O-ring 74 from migrating within the inner lumen 69 when the socket 46 is inserted therein.

To provide the operator with a gripping surface, lift calibration dial 66 may further include one or more O-rings 76 disposed about the outer surface of the cylindrical portion 68. The one or more O-rings 76 provide a gripping surface for the operator to grip and rotate the lift calibration dial 66.

FIG. 9 is a plan view of the lift calibration dial 66 of FIG. 8 disposed about socket 46. In this position, the socket 46 can be connected to the socket fitting 42 in preparation for adjusting the vertical positioning of housing 30 and router 31 relative to top plate 12. Once connected, the frictional force exerted by the O-ring 74 onto the socket 46 can be overcome by twisting lift calibration dial 66 relative to the socket 46 until the zero point mark on scale 72 is aligned with the index mark 43 located on the top plate 12.

Once the zero point mark on lift calibration dial 66 is aligned with index mark 43, the operator can then rotate the socket 46 to adjust the height of the router 31 relative to the top plate 12. Lift calibration dial 66 is held in position relation to socket 46 such that lift calibration dial 66 and socket 46 rotate together. As the socket 46 is rotated, a scale 72 such as that illustrated in FIG. 10 can be used to determine the change in elevation of the router 31. For example, a 180° rotation of socket 46 in a clockwise direction will result in lifting router 31 $1/16^{th}$ of an inch. A 360° rotation will result in a $1/8^{th}$ inch rise. Counter-clockwise rotation of socket 46 will, conversely, lower router 31 in similar fashion.

Although the exemplary embodiment illustrated in FIG. 10 illustrates a scale having $1/128^{th}$ inch mark increments, it is to be appreciated that different scales may be employed depending on the pitch and/or lead of the screw threads of any given embodiment of power screw 34.

Having thus described the several embodiments of the present invention, those of skill in the art will readily appreciate that other embodiments may be made and used which fall within the scope of the claims attached hereto. Numerous advantages of the invention covered by this document have been set forth in the foregoing description. It will be understood that this disclosure is, in many respects, only illustrative. Changes may be made in details, particularly in matters of shape, size and arrangement of parts without exceeding the scope of the invention.

What is claimed is:

1. A router lift for adjustably positioning a router on a work surface, the router including a router chuck, the router lift comprising:

a top plate having a top surface, a bottom surface, and an opening therethrough adapted to receive a router bit;

one or more columns extending from the bottom surface of said top plate;

a router housing operatively coupled to the one or more columns, said router housing having a generally circular portion defining a cylindrical aperture configured to receive the router; and a power screw threadably connected through a first threaded opening on said top plate, and a second threaded opening on said router housing, the power screw being configured to shift the router housing between a first position wherein the router chuck is disposed above the top surface of the top plate and a second position wherein the router chuck is disposed below the top surface of the top plate.

2. The router lift of claim 1, wherein said top plate is formed from an aluminum alloy.

3. The router lift of claim 1, wherein said top plate is formed from cast iron.

4. The router lift of claim 1, wherein the opening on said top plate includes a recessed peripheral flange.

5. The router lift of claim 4, further comprising an insert plate having a top surface configured to lie flush with the top surface of said top plate.

6. The router lift of claim 1, wherein said generally circular portion includes means for adjusting the size of the cylindrical aperture.

7. The router lift of claim 6, wherein said means for adjusting the size of the cylindrical aperture comprises a slot extending through the generally circular portion of said router housing, said slot having one or more threaded openings configured to receive a screw.

8. The router lift of claim 1, wherein said router housing includes one or more cooling fins.

9. The router lift of claim 8, wherein said router housing is formed from a material having a greater thermal conductivity than the router.

10. The router lift of claim 1, wherein said router housing is formed of aluminum.

11. The router lift of claim 1, wherein said router housing is formed from nodular ductile iron.

12. The router lift of claim 1, wherein said router housing includes one or more collars configured to receive a corresponding one or more of the columns.

13. The router lift of claim 12, wherein each of the one or more columns includes a bushing configured to provide a clearance fit between the bushing and the column.

14. The router lift of claim 1, wherein said one or more columns and power screw are disposed on one side of the router housing such that the second threaded opening on said router housing is biased in an upward direction.

15. The router lift of claim 14, wherein the second threaded opening on said router housing further includes a back-loaded threaded bushing.

16. The router lift of claim 1, wherein the first threaded opening on said top plate includes a polymeric insert.

17. The router lift of claim 1, wherein said router includes a router bit secured to the router by the router chuck.

18. The router lift of claim 17, wherein said router chuck is a locking collet.

19. The router lift of claim 17, wherein said router bit can be changed or removed from the router chuck from above the top surface of the top plate.

20. The router lift of claim 1, further comprising a sleeve disposed about said router, said sleeve configured in size and shape to fit within the cylindrical aperture of said router housing.

21. The router lift of claim 1, further comprising a hex or socket fitting connected to said power screw, said fitting extending through at least part of the first threaded opening on said top plate.

22. The router lift of claim 21, further comprising a socket connected to said socket fitting.

23. The router lift of claim 1, further comprising an index mark disposed on the top surface of said top plate adjacent the first threaded opening.

24. The router lift of claim 1, further comprising a lift calibration dial having a cylindrical portion defining an inner lumen configured to receive a socket, and a disc portion having a scale.

25. The router lift of claim 24, wherein the inner lumen of said cylindrical portion includes an O-ring.

26. The router lift of claim 24, wherein said lift calibration dial includes a gripping surface.

27. The router lift of claim 26, wherein said gripping surface comprises one or more O-rings.

28. A router lift for adjustably positioning a router on a work surface, the router including a router chuck, the router lift comprising:

a top plate having a top surface, a bottom surface, and an opening therethrough adapted to receive a router bit;

one or more columns extending from the bottom surface of said top plate;

a router housing operatively coupled to the one or more columns, said router housing having a generally circular portion defining a cylindrical aperture configured to receive the router; and a power screw threadably connected through a first threaded opening on said top plate, and a second threaded opening on said router housing, the power screw being configured to shift the router housing between a first position wherein the router chuck is disposed above the top surface of the top plate and a second position wherein the router chuck is disposed below the top surface of the top plate;

wherein said one or more columns and power screw are disposed on one side of the router housing such that the second threaded opening on said router housing is biased in an upward direction.

29. The router lift of claim 28, wherein said top plate is formed from an aluminum alloy.

30. The router lift of claim 28, wherein said top plate is formed from cast iron.

31. The router lift of claim 28, wherein the opening on said top plate includes a recessed peripheral flange.

32. The router lift of claim 31, further comprising an insert plate having a top surface configured to lie flush with the top surface of said top plate.

33. The router lift of claim 28, wherein said generally circular portion includes means for adjusting the size of the cylindrical aperture.

34. The router lift of claim 33, wherein said means for adjusting the size of the cylindrical aperture comprises a slot extending through the generally circular portion of said router housing, said slot having one or more threaded openings configured to receive a screw.

35. The router lift of claim 28, wherein said router housing includes one or more cooling fins.

36. The router lift of claim 35, wherein said router housing is formed from a material having a greater thermal conductivity than the router.

37. The router lift of claim 28, wherein said router housing is formed of aluminum.

38. The router lift of claim 28, wherein said router housing is formed from nodular ductile iron.

39. The router lift of claim 28, wherein said router housing includes one or more collars configured to receive a corresponding one or more of the columns.

40. The router lift of claim 39, wherein each of the one or more columns includes a bushing configured to provide a clearance fit between the bushing and the column.

41. The router lift of claim 40, wherein the second threaded opening on said router housing further includes a back-loaded threaded bushing.

42. The router lift of claim 28, wherein the first threaded opening on said top plate includes a polymeric insert.

43. The router lift of claim 28, wherein said router includes a router bit secured to the router by the router chuck.

44. The router lift of claim 43, wherein said router chuck is a locking collet.

45. The router lift of claim 43, wherein said router bit can be changed or removed from the router chuck from above the top surface of the top plate.

46. The router lift of claim 28, further comprising a sleeve disposed about said router, said sleeve configured in size and shape to fit within the cylindrical aperture of said router housing.

47. The router lift of claim 28, further comprising a hex or socket fitting connected to said power screw, said fitting extending through at least part of the first threaded opening on said top plate.

48. The router lift of claim 47, further comprising a socket connected to said socket fitting.

49. The router lift of claim 28, further comprising an index mark disposed on the top surface of said top plate adjacent the first threaded opening.

50. The router lift of claim 28, further comprising a lift calibration dial having a cylindrical portion defining an inner lumen configured to receive a socket, and a disc portion having a scale.

51. The router lift of claim 50, wherein the inner lumen of said cylindrical portion includes an O-ring.

52. The router lift of claim 50, wherein said lift calibration dial includes a gripping surface.

53. The router lift of claim 52, wherein said gripping surface comprises one or more O-rings.

54. A system for changing a router bit from a work surface, the router including a router chuck, said system comprising:

a router lift comprising:

a top plate having a top surface, a bottom surface, and an opening therethrough adapted to receive a router bit;

one or more columns extending from the bottom surface of said top plate;

a router housing operatively coupled to the one or more columns, said router housing having a generally circular portion defining a cylindrical aperture configured to receive the router; and a power screw threadably connected through a first threaded opening on said top plate, and a second threaded opening on said router housing, the power screw being configured to shift the router housing between a first position wherein the router chuck is disposed above the top surface of the top plate and a second position wherein the router chuck is disposed below the top surface of the top plate;

a router table having an opening therein configured to receive the top plate of the router lift;

a socket configured to engage a socket fitting disposed on the power screw; and a lift calibration dial having a cylindrical portion defining an inner lumen configured to receive the socket, and a disc portion having a scale.

* * * * *